United States Patent [19]

Erickson et al.

[11] Patent Number: 4,651,486

[45] Date of Patent: Mar. 24, 1987

[54] TRANSLUCENT BLOCK FOR WALL AND COLUMN STRUCTURES

[75] Inventors: Kenneth J. Erickson, Pittsburgh; Thomas J. Pirosko, McMurray; Francis J. Zavada, Aliquippa, all of Pa.

[73] Assignee: Pittsburgh Corning Corporation, Pittsburgh, Pa.

[21] Appl. No.: 739,987

[22] Filed: May 31, 1985

[51] Int. Cl.[4] ..... E04B 5/46

[52] U.S. Cl. ..... 52/306; 52/605; 52/608; 65/58

[58] Field of Search ..... 52/306, 307, 308, 309.4, 52/477, 608, 605, 79.4, 311, DIG. 10, 609, 604; 404/34; 65/58; 446/85

[56] References Cited

U.S. PATENT DOCUMENTS

| | | | |
|---|---|---|---|
| Des. 85,320 | 10/1931 | Bowman | D25/72 |
| Des. 109,025 | 3/1938 | Perkins | D25/72 |
| Des. 114,085 | 4/1939 | Lockart | D25/72 |
| Des. 114,086 | 4/1939 | Lockart | D25/72 |
| Des. 193,392 | 8/1962 | Kingsbury | D25/72 |
| Des. 198,626 | 7/1964 | Lockart et al. | D25/72 |
| Des. 210,372 | 3/1968 | Behnk | D25/72 |
| Des. 210,373 | 3/1968 | Behnk | D25/72 |
| Des. 217,924 | 6/1970 | Clostermann | D25/72 |
| 2,086,185 | 7/1937 | Keaney | 52/306 |
| 3,798,861 | 3/1974 | Weiss | 52/306 |
| 4,023,319 | 5/1977 | Kurata | 52/308 |

FOREIGN PATENT DOCUMENTS

| | | | |
|---|---|---|---|
| 567594 | 5/1958 | Belgium | 52/306 |
| 470835 | 11/1935 | United Kingdom | 52/306 |

OTHER PUBLICATIONS

"Glass Block by Pittsburgh Corning", Exterior and Interior Applications, Mar. 1978, p. 6.

*Primary Examiner*—William F. Pate, III
*Assistant Examiner*—Naoko N. Slack
*Attorney, Agent, or Firm*—Stanley J. Price, Jr.

[57] ABSTRACT

A translucent block includes a pair of parallel upper and lower faces each having a generally irregular hexagonal shape. There are a pair of generally rectangular, opposing sides which are parallel with each other, have a first preselected height and a first preselected width, and are perpendicular and joined to the upper and lower faces. A first pair of generally rectangular, opposing ends are parallel with each other, have the first preselected height and a second preselected width, and are perpendicular and joined to the upper and lower faces. A second pair of generally rectangular, opposing ends are parallel with each other, have the first preselected height and the second preselected width, and are perpendicular and joined to the upper and the lower faces. One of the first pair of ends is joined to one of the second pair of ends with a predetermined angle of ninety degrees therebetween. Each of the first pair of ends and each of the second pair of ends are respectively joined to one of the pair of sides. The translucent block can be joined to similar translucent blocks and/or different translucent blocks to form a wide variety of wall and column structures. There is included a method of forming the wall structures and a method of forming the column structures.

22 Claims, 23 Drawing Figures

TRANSLUCENT BLOCK FOR WALL AND COLUMN STRUCTURES

BACKGROUND OF THE INVENTION

1. Field of the Invention

This invention relates to a translucent block and, more particularly, to such a translucent block having a generally irregular hexagonal configuration which can be utilized with similar translucent blocks and blocks of other shapes to provide various column and wall structures. The invention also includes the method of forming such column and wall structures.

2. Description of the Prior Art

The use of translucent block, such as glass block, for exterior and interior applications is well known. Using glass block for various wall structures offers various aesthetic and design possibilities, as well as provides various functional characteristics and advantages over other materials which may be used for similar purposes. For example, glass block structures promote energy conservation through their insulating capability to reduce heat gain or less and provide thermal efficiencies for energy conservation. Additionally glass block structures can control light transmission and glare, as well as reduce surface condensation, draft and noise transmission. Because of their construction, glass block structures offer security advantages while maintaining light transmission therethrough. Lastly, glass block structures have the added advantage of ease of maintenance and installation.

The publication "Glass Block by Pittsburgh Corning, Exterior and Interior Applications", by Pittsburgh Corning Corporation, pages 3–15 (March, 1978) discloses and illustrates various types of glass block of a generally rectangular configuration. However, there is also shown therein a block having a generally pentagonal configuration which is capable of being aligned with two blocks of the generally rectangular configuration to serve as a corner piece. Although satisfactorily serving this function, the generally pentagonal corner block would appear to have little if any other uses. The publication generally illustrates and briefly describes the installation of glass block in glass block structures.

U.S. Pat. No. Des. 114,086 also discloses a corner block configuration which would appear to have little if any other function. The primary difference in the corner block disclosed therein and the pentagonal corner block mentioned hereinabove is in the shape of the resulting corner of the wall, whether it is curved or at a right angle.

U.S. Pat. No. 2,806,185 discloses an integrally blown hollow glass block of regular hexagonal form. This prior art patent also discloses a masonry structure or wall including the hexagonal glass blocks laid up with mortar in a configuration where the hexagonal sides would combine to form the exterior surface of the structure or wall. The blocks discloses therein include hollow, blown glass bodies having stress resisting walls.

Accordingly, there remains a need for any translucent block configuration or design which can be conveniently employed as a corner piece for adjoining translucent block walls or can be independently employed to form walls and columns of different designs and configurations.

SUMMARY OF THE INVENTION

In accordance with the present invention, there is provided a translucent block including a pair of parallel upper and lower faces each having a generally irregular hexagonal shape. A pair of generally rectangular, opposing sides are parallel with each other, have a first preselected height and a second preselected width, and are perpendicular and joined to the upper and the lower faces. A first pair of generally rectangular, opposing ends are parallel with each other, have the first preselected height and a second preselected width, and are perpendicular and joined to the upper and the lower faces. A second pair of generally rectangular, opposing ends are parallel with each other, have the first preselected height and the second preselected width, and are perpendicular and joined to the upper and the lower faces. One of the first pair of the ends is joined to one of the second pair of the ends with a predetermined angle therebetween. Each of the first pair of the ends and each of the second pair of the ends is respectively joined to one of the pair of the sides.

Further, in accordance with the present invention, there is provided a translucent block wall structure including a first translucent block having a pair of parallel upper and lower faces each having a generally irregular hexagonal shape. A pair of generally rectangular, opposing sides are parallel with each other, have a first preselected height and a first preselected width, and are perpendicular and joined to the upper and the lower faces. A second pair of generally rectangular, opposing ends are parallel with each other, have the first preselected height and a second preselected width, and are perpendicular and joined to the upper and the lower faces. A second pair of generally rectangular, opposing ends are parallel with each other, have the first preselected height and the second preselected width, and are perpendicular and joined to the upper and lower faces. One of the first pair of the ends is joined to one of the second pair of the ends and each of the first pair of the ends and each of the second pair of the ends is joined to one of the pair of the sides. A second translucent block includes a pair of parallel top and bottom surfaces of identical shape and a generally rectangular abutting surface having the first preselected height and being perpendicular and joined to the top and the bottom surfaces. One of the sides and the ends of the first block is joined in abutting relationship with the abutting rectangular surface of the second block with the abutting rectangular surface having a generally corresponding width which corresponds to an appropriate one of the first preselected width and the second preselected width of the one of the sides and the ends of the first block to form a horizontal layer of the translucent block wall structure.

The present invention also provides a method of forming such a translucent block wall structure.

Also, in accordance with the present invention, there is provided a translucent block column structure including a translucent block having a pair of parallel upper and lower faces each having a generally irregular hexagonal shape. A pair of generally rectangular, opposing sides are parallel with each other, have a first preselected height and a first preselected width, and are perpendicular and joined to the upper and the lower faces. A first pair of generally rectangular, opposing ends are parallel with each other, have the first preselected height and a second preselected width, and are perpendicular and joined to the upper and the lower faces. A second pair of generally rectangular, opposing ends are parallel with each other, have the first preselected height and the second preselected width, and are perpendicular and joined to the upper and the lower faces. One of the first pair of the ends is joined to one of the second pair of the ends and each of the first pair of the ends and each of the second pair of the ends are joined to one of the pair of the sides. There are a plurality of at least three additional translucent blocks, each of which respectively include a pair of parallel upper and lower surfaces having identical shapes. A first of the additional translucent blocks has a first generally rectangular abutting surface having the first preselected height and being perpendicular and joined to the upper and the lower surfaces thereof. A second of the additional translucent blocks has a second generally rectangular abutting surface having the first preselected height and being perpendicular and joined to the upper and the lower surfaces thereof. One of the sides and the ends of the translucent block is joined in abutting relationship with the first abutting rectangular surface of the first additional translucent block with the first abutting rectangular surface having a first corresponding width which corresponds to an appropriate one of the first preselected width and the second preselected width of the one of the sides and the ends of the translucent block. Another of the sides and the ends of the translucent block is joined in abutting relationship with the second abutting rectangular surface of the second additional transluent block with the second abutting rectangular surface having a second corresponding width which corresponds to an appropriate one of the first preselected width and the second preselected width of the other of the sides and the ends of the translucent block. The translucent block and the additional translucent blocks are joined in an encircling array to form a horizontal layer of the translucent block column structure.

There is also provided a method of forming such a translucent block column structure.

Accordingly, it is an object of the present invention to provide a generally irregular hexagonal translucent block to provide functionality and versatility in translucent block wall and column structures.

An additional object of the present invention is to provide such a translucent block which is capable of providing increased functional capabilities and uses for translucent blocks.

A further object of the present invention is to provide a method for forming a wide variety of wall and column structures by the use of at least some of the translucent blocks of generally irregular hexagonal configuration.

These and other objects of the present invention will be more completely disclosed and described in the following specification, the accompanying drawings, and the appended claims.

DESCRIPTION OF THE PREFERRED EMBODIMENTS

Figure 1:
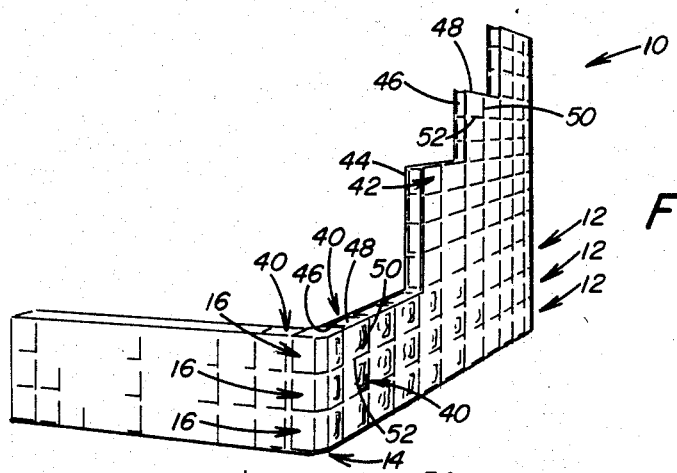
FIG. 1 is a perspective view of a portion of a translucent block wall structure having an integrally joined corner section including a translucent block of generally irregular hexagonal configuration.
Figure 3:
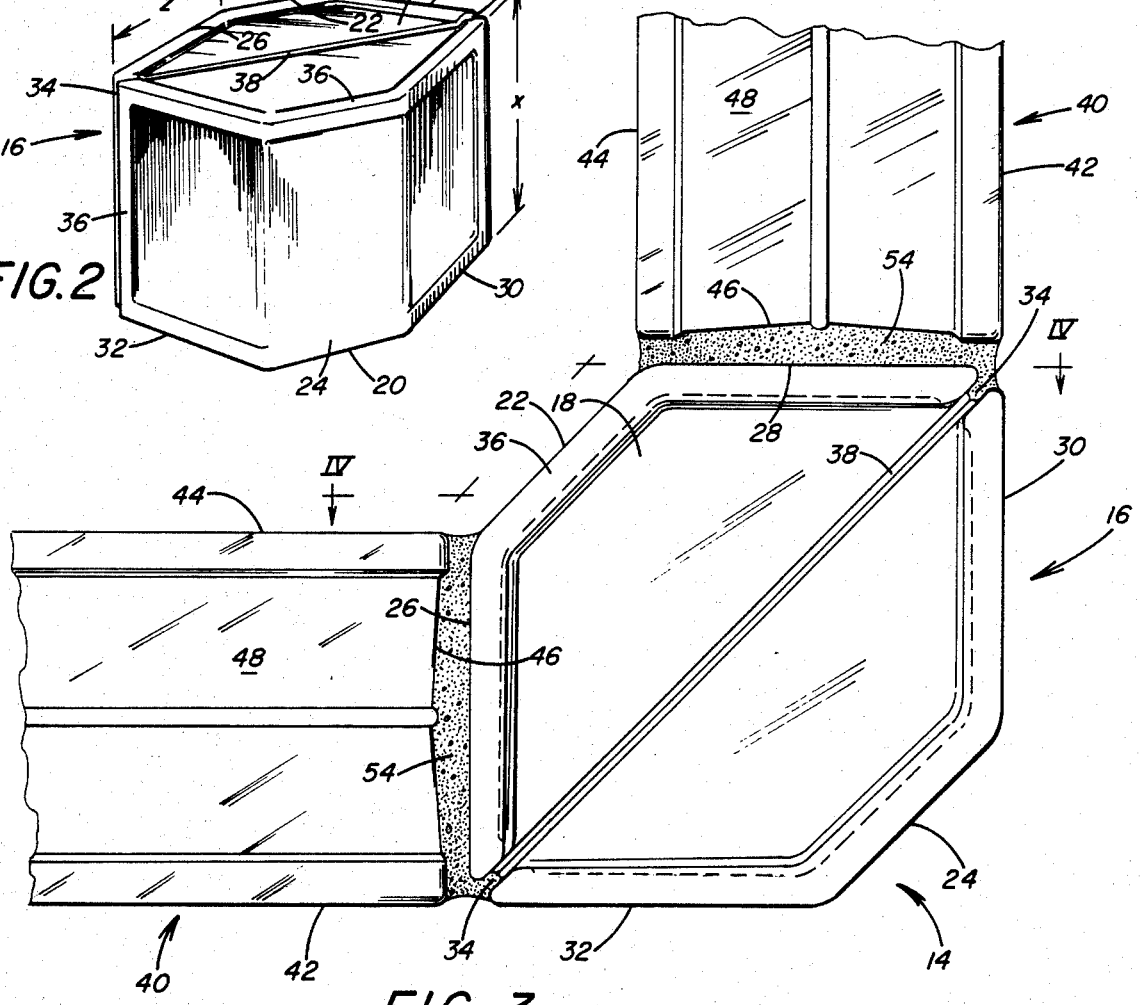
FIG. 3 is a fragmentary, top view showing a corner section including the preferred translucent block of a generally irregular hexagonal configuration according to the present invention.
Figures 5, 6, 7, 8, 9, 10:
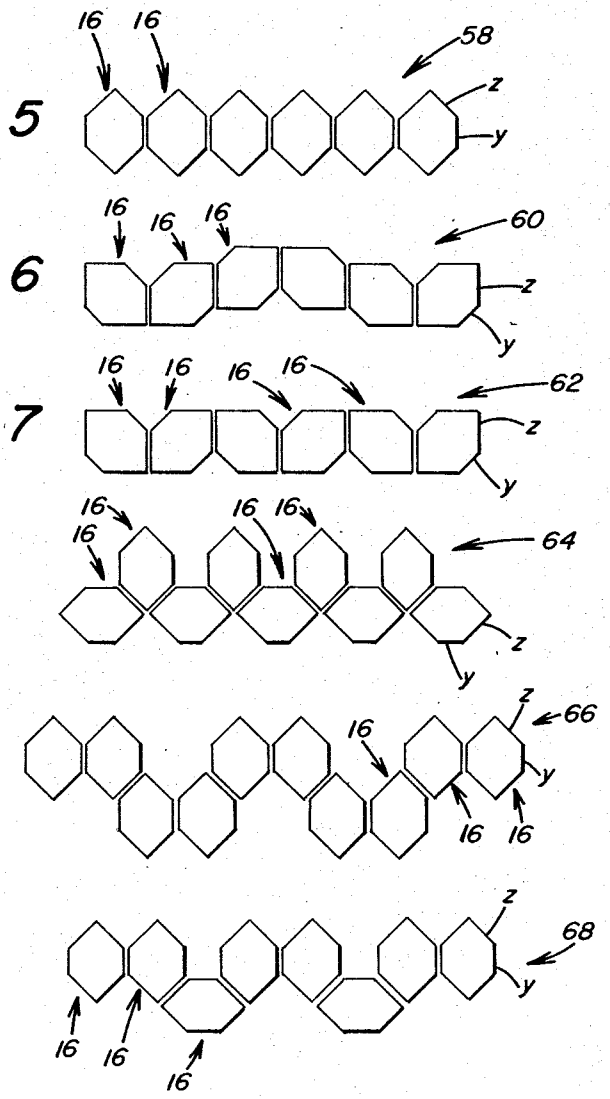
FIGS. 5–10 show in schematic form a top view of various translucent block wall structures including the preferred generally irregular hexagonal translucent blocks of the present invention.
Figure 4:
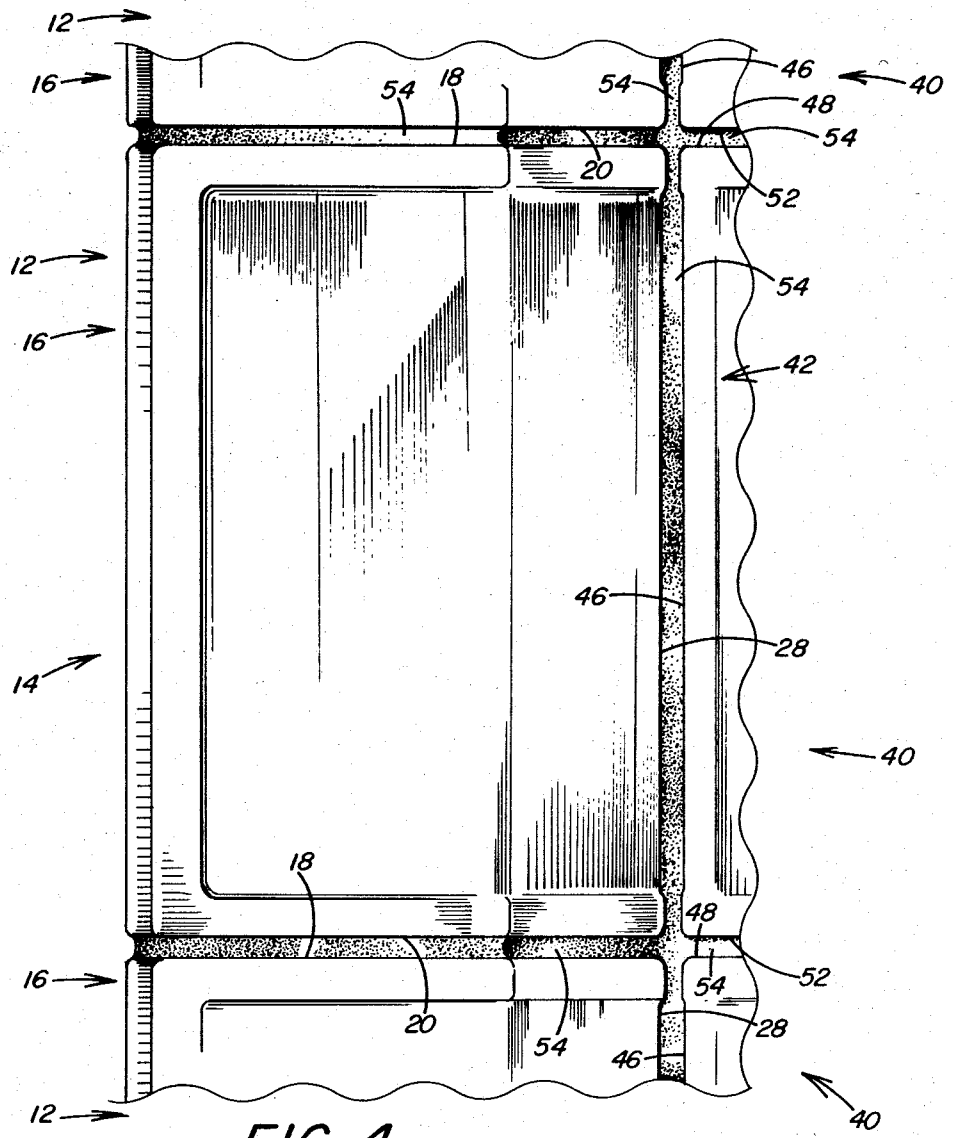
FIG. 4 is a fragmentary, elevational view of the translucent block wall structure of FIG. 1 including the corner section thereof.
Figure 11:
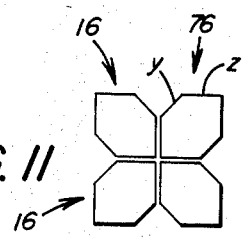
FIGS. 11–17 show in schematic form a top view of various translucent block column structures including the preferred generally irregular hexagonal translucent blocks of the present invention.
Figure 12:
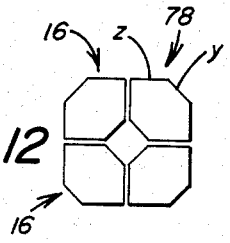
Figure 13:
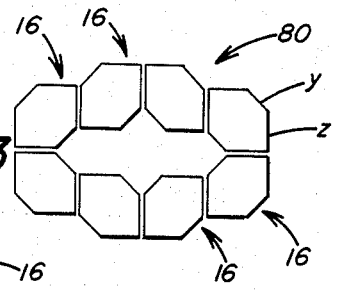
Figure 14:
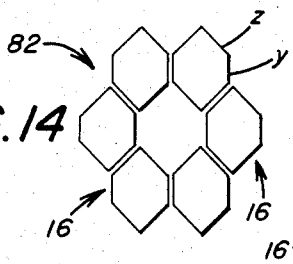
Figure 15:
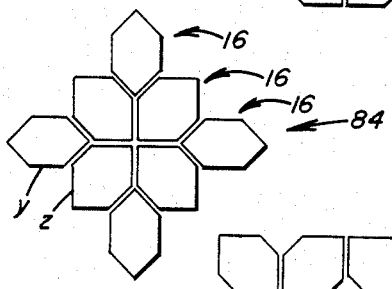
Figure 16:
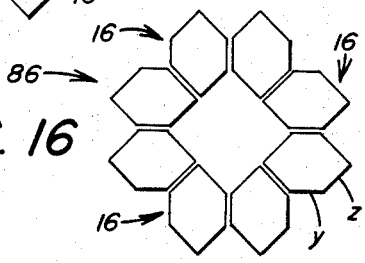
Figure 17:
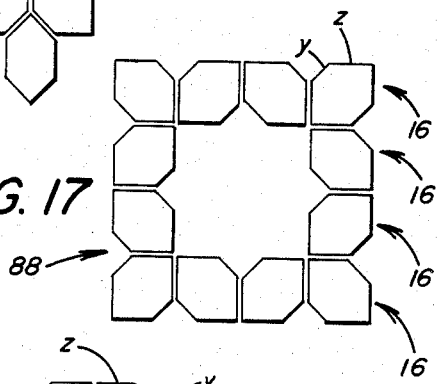

Referring to the drawings and particularly to FIGS. 1, 3, and 4, there is illustrated a translucent block wall structure 10, such as a glass block wall structure, having at least one layer of translucent block. The layers of translucent block are generally designated by the numeral 12. The translucent block wall structure 10 includes a corner section 14 with conventional, straight translucent block wall sections integrally joined therewith. The corner section 14 is illustrated in greater detail in FIGS. 3 and 4.

To form the corner section 14, the translucent block wall structure 10 includes a plurality of translucent blocks 16 having a generally irregular hexagonal configuration. One of the blocks 16 is illustrated in greater detail in FIG. 2. By "irregular", it is meant that the block 16 has an outward configuration which is generally an irregular hexagon. In other words, the six sides or faces forming the "hexagon" need not all be substantially equal with each other and adjacent sides do not meet at a 120 degree angle. However, as will be seen, some of the sides are equal to other specific sides to provide the desired features which allow the block 16 to be used in numerous ways to provide walls and columns of translucent blocks which were not heretofore possible.

The preferred translucent block 16 has an upper surface or face 18 and a lower surface face 20 of the generally irregular hexagonal configuration which are identical. The upper surface 18 is shown in FIGS. 2 and 3 and the lower surface 20 is indicated in FIGS. 2 and 4 although not specifically visible therein.

Figure 2:
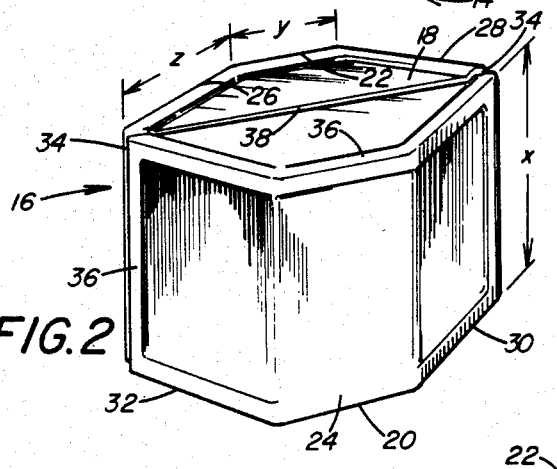
FIG. 2 is a perspective view of a generally irregular hexagonal translucent block of the present invention.

The block 16 also has two sides or side faces 22 and 24 of generally rectangular configuration of a preselected height, indicated by the length "x", and of a first preselected width, indicated by the length "y", as shown in FIG. 2. Sides 22 and 24 of width y are oppositely positioned from each other on block 16 and are perpendicular and integrally joined to upper face 18 and lower face 20 of block 16.

The preferred block 16 also includes four end faces 26, 28, 30, 32, respectively of a generally rectangular configuration. The ends 26, 28, 30, and 32 are of a preselected height x, equal to the preselected height x of sides 22 and 24, and of a second preselected width, indicated by the length "x", in FIG. 2. As will be seen, the actual numerical values of the first preselected width y and the second preselected width z are totally independent of each other and may be specifically selected for various design configurations and purposes.

In FIG. 2, the second preselected width z is greater than the first preselected width y. This arrangement might be preferred for applications involving wall structures where the preferred block 16 is adjoined to generally rectangular block as to be discussed hereinbelow. However, in other applications, it may be desirable for the first preselected width y to be equal to or greater than the second preselected width z as discussed hereinbelow with regard to other embodiments of the invention.

It can now be seen that, since the end faces 26, 28, 30, and 32 are also perpendicular to and join with the upper surfaces 18 and the lower surface 20, if the widths z and y are different, the different lengths of some of the edges of the surfaces 18, 20 would contribute to the upper face 18 and lower face 20 being generally defined as irregular hexagonal shapes. However, there are other relationships between the sides or side faces 22 and 24 and the ends or end faces 26, 28, 30 and 32 which provide the overall shape of the preferred block 16 which contributes to its versatility and adaptability for use in various structures and columns. As mentioned hereinabove, a regular hexagon would have adjacent sides which meet at a 120 degree angle. Additionally, opposite sides of such a hexagon would be parallel to each other. As can be clearly seen in FIG. 3, the opposite sides 22, 24 and the opposite ends 26, 30 and 28, 32 are also parallel. However, there are other angular relationships between the various ends and sides which should be discussed. For example, the adjacent ends 26, 32 and the adjacent ends 28, 30 respectively meet at identical angles which are not 120 degrees. Specifically, the ends 26, 32 and the ends 28, 30 will preferably be perpendicular and join at a 90 degree angle. Further, the non-adjacent, non-parallel ends 26, 28 do not join to each other but preferably lie in planes which, if extended, would intersect at a 90 degree angle. Similarly, the non-adjacent, non-parallel sides 30, 32 do not join to each other but again preferably lie in planes which, if extended, would intersect each other at a 90 degree angle. Since the ends 26, 28, 30, 32 all have identical widths z and since the sides 22, 24 have identical widths y, it should now be clear that each of the sides 22, 24 preferably joins adjacent ends at an angle of 135 degrees.

The specific significants of these relationships will be discussed hereinbelow when discussing the various configurations in which the preferred block 16 can be employed.

However, before proceeding with an explanation of the various advantages which the overall configuration of the preferred block 16 provides, there are other features which should be discussed. Specifically, the preferred block 16 includes a channel-like spacing 34 respectively between adjacent ends 26, 32 and 28, 30 to promote joining of block 16 with other translucent blocks. For example, the spacing 34 will be employed when an end of the block 16 is joined to an abutting surface of a generally rectangular translucent block in forming a corner section 14 of the wall 10. Additionally, the outer periphery of the sides 22 and 24 and the ends 26, 28, 30 and 32 and the faces 18 and 20 preferably include a raised portion 36 to provide a slightly inward displaced appearance for a substantial portion of the sides, ends, faces to permit joining of any side, end, or face of the block 16 with other identical or different blocks in a translucent block structure.

Block 16 can be composed of any suitable translucent material, such as a suitable glass material, and can be formed by any conventional glass forming process known in the art. Block 16 is desirably a hollow glass block and is preferably formed from pressing two halves of block together under appropriate temperature and pressure conditions using known conventional processes and apparatus. In fact, although not shown to include the wide variety of possible designs in the figures, the forming process usually includes providing the interior surface of the sides 22, 24 and the ends 26, 28, 30, 32 with some type of molded decorative design which is clearly visible through the glass material after the halves of the block 16 are joined. Accordingly, as will be further discussed hereinbelow, it is significant that each of the sides 22, 24 and ends 26, 28, 30, 32 provides an exterior decorative appearance for the block 16, as generally indicated in FIGS. 2 and 4, which significantly contributes to its overall aesthetic value as a construction material. The location of the fusion of the two pressed halves of block forming the unitary block 16 is indicated at numeral 38 in FIGS. 2 and 3. Each of the halves of the block 16 are identical and include one of the sides 22, 24, each of the ends 26, 32 and ends 28, 30 joined thereto, and an adjoining half of the upper face 18 and lower face 20.

While it should be clear from the figures that the preferred block 16 can serve the same function and purpose generally provided by the rounded and right angled corner blocks discussed in the prior art hereinabove, it should also be clear that the preferred block 16 can be more easily provided and utilized than can these prior art blocks. Specifically, since the two halves of the block 16 are identical, only one mold must be provided to basically form the identical halves while at least two different molds should be required for the two different halves of the prior art corner blocks. Further, because of the symmetry of the blocks 16, there is no specific "outside" face which must be particularly oriented when forming a corner section 14 of a wall 10. This could clearly not be said for either of the corner blocks mentioned hereinabove. Finally, because of the parallel configuration of the opposite sides and ends of the preferred block 16, it should be clear that large quantities of the preferred block 16 can be more readily stacked and packaged for delivery to a construction site than could either of the prior art corner blocks.

As mentioned hereinabove, the shape, size, and dimensions of block 16 can vary depending upon the particular application. A typical block 16 for use in a translucent block structure would have a preselected height x of about $7\frac{3}{4}$ inches, a first preselected width y of about $2\frac{1}{2}$ inches, and a second preselected width z of about $3\frac{5}{8}$ inches. When block 16 is used in a translucent block wall structure 10 where the ends are joined to a generally rectangular block or blocks, the preselected height x and preselected width z are chosen to be equal to the height and width of the abutting surface of the rectangular block or blocks to be joined thereto.

Consequently, the translucent block wall structure 10 also includes a plurality of translucent blocks 40 of a generally rectangular configuration. Blocks 40 can be selected from any number of conventional, generally rectangular translucent block configurations. For example, the blocks 40 have a front face 42 and a rear face 44 which are generally rectangular. The front face 42 is generally shown in FIG. 1 and indicated in FIGS. 3 and 4. The rear face 44 is shown in FIGS. 1 and 3. The faces 42, 44 are substantially identical in appearance.

The blocks 40 also have four abutting surfaces 46, 48, 50 and 52 which are generally rectangular as indicated in FIGS. 1, 3 and 4. Because the particular rectangular faces 42, 44 of the block 40 shown in the figures are preferably in the form of a square, the abutting surfaces 46, 48, 50 and 52 are substantially similar to each other in appearance and configuration. However, because of the method of forming the block 40 and the normal use of any abutting surface to join any other abutting surface, the appearance of the abutting surface is not particularly governed by aesthetic consideration as might be the appearance of the faces 42, 44. The blocks 40 would preferably be formed in a similar manner as the blocks 16 and the molding of the separate halves thereof would again normally include decorative designs on the interior surfaces of the faces 42, 44 but not on those associated with the abutting surfaces 46, 48, 50, 52.

Specifically, in the translucent block wall structure 10, the abutting surfaces 46, 48, 50 and 52 of blocks 40 are fixedly joined to adjacent abutting surfaces of adjacent blocks 40 as indicated in FIGS. 1 and 4. For example, the abutting surfaces can be joined by a suitable bonding material 54, such as a conventional cementitious material or a suitable adhesive material. Many types of commercially available bonding materials can be utilized in the present invention, such as a conventional cementitious material, or mortar including four parts Portland cement, three parts lime, and sixteen parts sand, measured by volume. The mortar can also include an integral waterproofing constituent. Other suitable bonding materials include adhesives, such as silicone.

Referring to FIGS. 3 and 4, there is illustrated a corner section 14 of translucent block in a layer 12 of the translucent block structure 10. A block 16 is joined by a suitable bonding material, such as mortar, at ends 26 and 28 to abutting surfaces 46 of adjacent blocks 40. As mentioned hereinabove, to be properly employed to form the corner section 14, the heights x and the widths z of the ends 26, 28 30 and 32 and the abutting surfaces 46 should be substantially the same.

While FIGS. 3 and 4 illustrate the cement or adhesive bonding of two of the ends of block 16 to abutting surfaces 46 of two blocks 40, a corner section 14 of translucent block, according to the invention, can be formed by the bonding of at least one translucent block 40 of generally rectangular configuration to at least one translucent block 16 of generally irregular hexagonal configuration. For example, if one were to utilize a single straight wall of blocks 40, it would be possible to provide the terminal end of the wall with a "corner section" 14 of blocks 16 to provide an ending for the wall which is more attractive than simply ending the wall with a vertical array of blocks 40. Consequently, the blocks 16 can be utilized by being joined to corresponding blocks 40 at an opening in a wall such as a door or passageway.

It would appear that the generally pentagonal corner block mentioned in the discussion of the prior art hereinabove might also be employed for a similar purpose. However, the generally pentagonal corner block has a larger right angle corner which may not be as aesthetically pleasing as the block 16 and may be less desirable for use at a passageway or door opening where there may be considerable pedestrian traffic. On the other hand, it would appear that the curved corner block discussed in the prior art hereinabove might also be satisfactorily employed for this purpose. However, the "end" of the curved corner block does not appear to have been aesthetically considered when it was being designed and does not appear to be considered for use in situations where it might be desirable to provide it with a decorative appearance. Further, although the generally pentagonal corner block would appear to include such features, the rounded or curved corner block would not appear to be particularly conveniently alignable with another single straight wall section because of the type of curved surfaces on either of the exposed sides thereof. Although the "ends" of the curved corner block may appear to be such that they would easily mate with abutting surfaces of adjacent rectangular blocks, alignment would more than likely be easier if there were a surface such as an adjacent end of the block 16 which would be directly alignable with the outer faces of the rectangular block wall to which it is to be joined.

It should now be clear that one of the primary features of the present invention includes a configuration having sides and ends which are all capable of including an aesthetically pleasing decorative design or, alternatively, capable of being used to join to other sides or ends of other blocks 16 or abutting surfaces of differently shaped blocks such as a block 40. In fact, the versatility of the block 16 can be further demonstrated by the fact that it would be possible to join four blocks 40 to a single block 16. For example, a single block 16 could be employed to initially position four walls of blocks 40 therefrom to provide a common corner for four adjacent rooms or areas to be divided by walls of the blocks 40. In fact, if the sides 22 and 24 were properly dimensioned, it would even be possible, if desired, to add two alternative or additional walls of blocks 40 from the same block 16. Consequently, it should be clear that the preferred block 16 can be conveniently employed to provide numerous construction designs and configurations when utilized in conjunction with the prior art rectangular block such as block 40 shown in the figures.

Although the descriptions provided hereinabove are primarily directed to a single layer 12 of blocks 16 and/or blocks 40, it should be clear that any number of types of wall and corner configurations can be provided by employing multiple layers 12 of such blocks in a conventional manner when constructing a wall.

Referring to FIGS. 5–10 and 18–20, various translucent block wall structures are schematically shown from a top view to include a plurality of the generally irregular hexagonal translucent blocks of the present invention. Although only a top layer of the translucent blocks can be seen in these figures, these wall structures could include any number of such layers of the translucent blocks as may be required. The generally irregular hexagonal translucent blocks as shown in these figures represent various arrangements of blocks and do not necessarily show each detail hereof, since the detailed construction of the generally irregular hexagonal blocks 16 has been discussed hereinabove.

Figure 18:
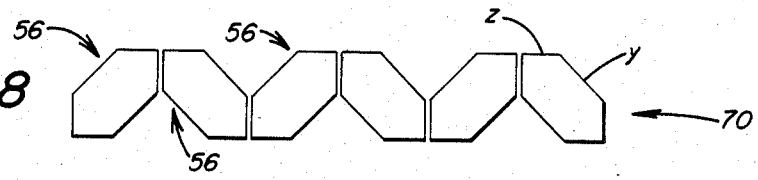
FIGS. 18–20 show in schematic form a top view of various translucent block wall structures including an alternative generally irregular hexagonal translucent block of the present invention.
Figure 19:
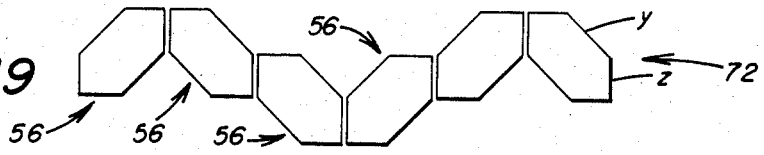
Figure 20:
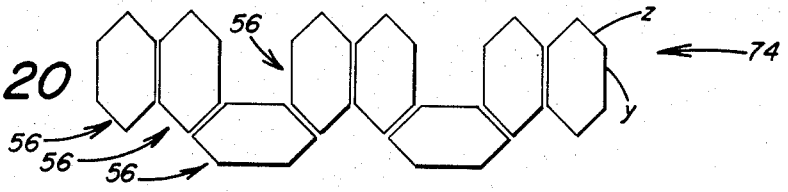

The blocks 16 shown in FIGS. 5–10 are similar to that shown in FIG. 2 in that the first preselected width y is less than the second preselected width z. The blocks 56 shown in FIGS. 18–20 are similar to the block 16 of FIG. 2 with the exception that the first preselected width y is greater than the second preselected width z.

Although only illustrative of the numerous types of translucent block wall structures which can be formed, the wall structures 56, 60, 62, 64, 66, 68, 70, 72, and 74 corresponding to FIGS. 5, 6, 7, 8, 9, 10, 18, 19, and 20 specifically show how the blocks 16, 56 include features for versatility of architectural design and construction. Clearly, these translucent block wall structures and other translucent block wall structures not specifically shown can be formed by the selective joining of any number of the sides 22, 24 and/or the ends 26, 28, 30, 32 to corresponding abutting surfaces in the form of other sides 22, 24 and/or ends 26, 28, 30, 32 of similarly configured blocks 16 and 56. Further, although not specifically shown, it should be clear that additional wall structures could be formed including both the blocks 16 and the blocks 56 where the abutting surfaces thereon have a similar rectangular configuration with the identical height x and a corresponding width y or z. The blocks 16 and/or 56 would, of course, again be joined by a suitable cementitious or adhesive material 54 in a conventional manner, as previously described hereinabove. Of course, in order to provide the multiple layers of the wall structures as described, the upper faces 18 would be joined to lower faces 20 of corresponding blocks 16 and/or 56 with a similar bonding material 54 in order to add sufficient integrity to the entire wall structure.

The configurations of the translucent block wall structures illustrated in FIGS. 5–10 and 18–20, as well as other possible configurations utilizing the generally irregular hexagonal translucent blocks of the invention, may be used for various applications, such as for translucent block walls or windows. Further, depending upon the particular configuration, varying degrees of light transmission through the translucent block wall structures are possible. For example, the configurations of FIGS. 5–7 permit relatively high light transmission therethrough; and the configurations of FIGS. 8–10 permit varying degrees of light transmission therethrough.

Referring to FIGS. 11–17 and 21–23, various translucent block column structures utilizing the generally irregular hexagonal translucent blocks of the invention are illustrated from the top in schematic form. Although only a top layer of the translucent blocks can be seen in these figures, the translucent block column structures of the present invention could include any number of such layers of the translucent blocks as may be required. Again, the generally irregular hexagonal translucent blocks as shown in these figures represent various arrangements of the blocks and do not necessarily show each detail thereof since the detailed construction of the generally irregular hexagonal blocks 16 has been discussed hereinabove.

Figure 21:
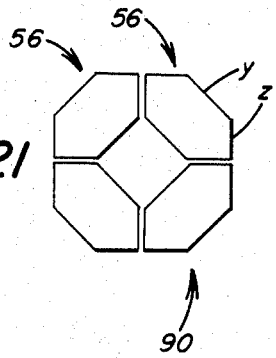
FIGS. 21–23 show in schematic form a top view of various translucent block column structures including an alternative generally irregular hexagonal translucent block of the present invention.
Figure 22:
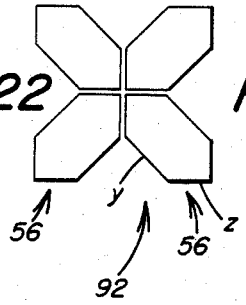
Figure 23:
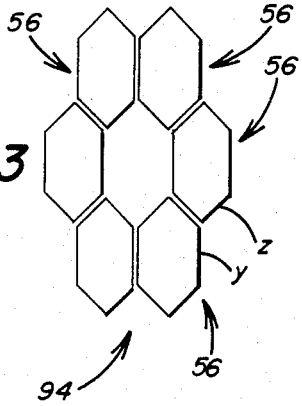

The blocks 16 in FIGS. 11–17 are similar to that shown in FIG. 2 where the second preselected width z is greater than the first preselected width y. The generally irregular hexagonal translucent blocks 56 of FIGS. 21–23 are similar to those shown in FIGS. 18–20 where the first preselected width y is greater than the second preselected width z.

Again, although only illustrative of the numerous types of translucent block column structures which can be provided, the column structures 76, 78, 80 82, 84, 86, 88, 90, 92, and 94 respectively corresponding to FIGS. 11, 12, 13, 14, 15, 16, 17, 21, 22, and 23 specifically show how the blocks 16, 56 include features for versatility of architectural design and construction of column structures. Clearly, these translucent block columns and other translucent block column structures not specifically shown can be formed by the selective joining of any number of the sides 22, 24 and/or the ends 26, 28, 30, 32 to corresponding abutting surfaces in the form of other sides 22, 24 and/or ends 26, 28, 30, 32 of similarly configured blocks 16 and 56. Further, although not specifically shown, it should be clear that additional column structures could be formed including both the block 16 and the blocks 56 where the abutting surfaces thereon have a similar rectangular configuration with the identical height x and a corresponding width y or z. The blocks 16 and/or 56 would, of course, again be joined by a suitable cementitous or adhesive material 54 in a conventional manner, as previously described hereinabove. Further, in order to provide the multiple layers of the column structures as described, the upper faces 18 would be joined to lower faces 20 of corresponding blocks 16 and/or 56 with a similar bonding material 54 in order to add sufficient integrity to the entire column structure.

To qualify as a column structure, it can be seen that each of the embodiments disclosed in FIGS. 11–17 and 21–23 includes at least four blocks 16 and/or 56. Consequently, the columns shown therein can be defined to include an encircling array of such blocks in each layer thereof even though some of the adjacent blocks 56 are cementitiously joined to form the configuration for the translucent block column structure of FIG. 23.

In summary, the present invention provides a generally irregular hexagonal translucent block, such as a glass block, and translucent block structures and methods utilizing a generally irregular hexagonal translucent block to enhance the uses for translucent block and translucent block structures. Thus, the present invention provides additional functional ability and versatility for translucent block.

According to the provisions of the Patent Statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A translucent corner block comprising:

a pair of parallel upper and lower surfaces each having a generally irregular hexagonal shape;

a pair of generally rectangular, opposing side faces which are parallel with each other, have a first preselected height and a first preselected width, and are perpendicular and joined to said upper and said lower surfaces;

a first pair of generally rectangular, opposing end faces which are parallel with each other, have said first preselected height and a second preselected width, and are perpendicular and joined to said upper and said lower surfaces;

a second pair of generally rectangular, opposing end faces which are parallel with each other, have said first preselected height and said second preselected width, and are perpendicular and joined to said upper and said lower faces;

one of said first pair of said end faces being joined to one of said second pair of said end faces with a predetermined angle therebetween;

each of said first pair of said end faces and each of said second pair of said end faces being respectively joined to one of said pair of said side faces; and a channel means at a junction of said one of said first pair of said end faces and said one of said second pair of said end faces.

2. The translucent block as set forth in claim 1, wherein each of said side faces and each of said end faces has a decorative appearance.

3. The translucent block as set forth in claim 1, wherein each of said side faces and each of said end faces are arranged to be joined in abutting relationship with an abutting rectangular surface of another block which said abutting rectangular surface has said first preselected height and a generally corresponding preselected width.

4. The translucent block as set forth in claim 1, wherein said block is formed of two identical halves, each half including said one of said pair of said side faces and said each of said first pair of said end faces and said each of said second pair of said end faces joined thereto and an adjoining half of said upper and said lower surfaces.

5. The translucent block as set forth in claim 1, wherein each of said upper surface and said lower surface is arranged to be joined in abutting relationship with an abutting surface of another block which said abutting surface has a corresponding said generally irregular hexagonal shape.

6. The translucent block as set forth in claim 1, wherein said predetermined angle is ninety degrees.

7. A translucent block wall structure comprising:

a first translucent corner block including a pair of parallel upper and lower surfaces each having a generally irregular hexagonal shape, a pair of generally rectangular, opposing side faces which are parallel with each other, have a first preselected height and a first preselected width, and are perpendicular and joined to said upper and said lower surfaces, a first pair of generally rectangular, opposing end faces which are parallel with each other, have said first preselected height and a second preselected width, and are perpendicular and joined to said upper and said lower surfaces, a second pair of generally rectangular, opposing end faces which are parallel with each other, have said first preselected height and said second preselected width, and are perpendicular and joined to said upper and said lower surfaces, one of said first pair of said end faces being joined to one of said second pair of said end faces, and each of said first pair of said end faces and each of said second pair of said end faces being joined to one of said pair of said side faces;

a second translucent block including a pair of parallel top and bottom surfaces of identical shape and a generally rectangular abutting surface having said first preselected height and being perpendicular and joined to said top and said bottom surfaces; and one of said side faces and said end faces of said first block being joined in abutting relationship with said abutting rectangular surface of said second block with said abutting rectangular surface having a generally corresponding width which corresponds to an appropriate one of said first preselected width and said second preselected width of said one of said side faces and said end faces of said first block to form a horizontal layer of said translucent block wall structure.

8. The translucent block wall structure as set forth in claim 7, further including a plurality of said horizontal layers wherein said upper surface of each of said first blocks is joined to said lower surface of each adjacent said first block thereabove and said top surface of each of said second blocks is joined to said bottom surface of each adjacent said second block thereabove.

9. The translucent block wall structure as set forth in claim 7, wherein said top surface and said bottom surface of said second block each have a second generally irregular hexagonal shape.

10. The translucent block wall structure as set forth in claim 7, wherein said top surface and said bottom surface of said second block each have a generally rectangular shape.

11. The translucent block wall structure as set forth in claim 7, wherein said horizontal layer includes another of said side faces and said end faces of said first block being joined in abutting relationship with another abutting rectangular surface of a third block which said another abutting rectangular surface has said first preselected height and a particular preselected width which corresponds to an appropriate one of said first preselected width and said second preselected width of said another of said side faces and said end faces of said first block.

12. The translucent block wall structure as set forth in claim 11, wherein said first, said second, and said third blocks are identical.

13. The translucent block wall structure as set forth in claim 11, wherein said one of said first pair of said end faces is joined to said one of said second pair of said end faces at a predetermined angle of ninety degrees, said one of said side faces and said end faces is a first end face of said first pair of said end faces, said another of said side faces and said end faces is a first end face of said second pair of, end faces said first end face of said first pair of said end faces and said first end face of said second pair of said end faces are not joined to each other, but if extended would be perpendicular to each other, and said top surface and said bottom surface of said second block have a generally rectangular shape and a pair of parallel upper and lower surfaces of said third block are generally rectangular in shape as said layer is formed into a right angle corner section.

14. A translucent block column structure comprising:

a translucent corner block including a pair of parallel upper and lower surfaces each having a generally irregular hexagonal shape, a pair of generally rectangular, opposing side faces which are parallel with each other, have a first preselected height and a first preselected width, and are perpendicular and joined to said upper and said lower surfaces, a first pair of generally rectangular, opposing end faces which are parallel with each other, have said first preselected height and a second preselected width, and are perpendicular and joined to said upper and said lower surfaces, a second pair of generally rectangular, opposing end faces which are parallel with each other, have said first preselected height and said second preselected width, and are perpendicular and joined to said upper and said lower surfaces, one of said first pair of said end faces being joined to one of said second pair of said end faces, and each of said first pair of said end faces and each of said second pair of said end faces being joined to one of said pair of said side faces;

a plurality of at least three additional translucent blocks each of which respectively includes a pair of parallel upper and lower surfaces having identical shapes;

a first of said additional translucent blocks having a first generally rectangular abutting surface having said first preselected height and being perpendicular and joined to said upper and said lower surfaces thereof;

a second of said additional translucent blocks having a second generally rectangular abutting surface having said first preselected height and being perpendicular and joined to said upper and said lower surfaces thereof;

one of said side faces and said end faces of said translucent block being joined in abutting relationship with said first abutting rectangular surface of said first of said additional translucent blocks with said first abutting rectangular surface having a first corresponding width which corresponds to an appropriate one of said first preselected width and said second preselected width of said one of said side faces and said end faces of said translucent block;

another of said side faces and said end faces of said translucent block being joined in abutting relationship with said second abutting rectangular surface of said second of said additional translucent blocks with said second abutting rectangular surface having a second corresponding width which corresponds to an appropriate one of said first preselected width and said second preselected width of said another of said side faces and said end faces of said translucent block; and said translucent block and said additional translucent blocks being joined in an encircling array to form a horizontal layer of said translucent block column structure.

15. The translucent block column structure as set forth in claim 14, further including a plurality of said horizontal layers wherein said upper surface of each of said translucent blocks is joined to said lower surface of each adjacent said translucent block thereabove and said upper surface of each of said additional translucent blocks is respectively joined to said bottom surface of each corresponding adjacent said additional translucent block thereabove.

16. The translucent block column structure as set forth in claim 14, wherein said upper surface and said lower surface of said first of said additional translucent blocks each have a generally irregular hexagonal shape.

17. The translucent block column structure as set forth in claim 14, wherein said upper surface and said lower surface of said second of said additional translucent blocks each have a generally irregular hexagonal shape.

18. The translucent block column structure as set forth in claim 14, wherein said translucent block and said additional translucent blocks are identical.

19. A method of forming a translucent block wall structure comprising of the steps of:

providing a first translucent corner block including a pair of parallel upper and lower surfaces each having a generally irregular hexagonal shape, a pair of generally rectangular, opposing side faces which are parallel with each other, have a first preselected height and a first preselected width, and are perpendicular and joined to said upper and said lower surfaces, a first pair of generally rectangular, opposing end faces which are parallel with each other, have said first preselected height and a second preselected width, and are perpendicular and joined to said upper and said lower surfaces, a second pair of generally rectangular, opposing end faces which are parallel with each other, have said first preselected height and said second preselected width, and are prependicular and joined to said upper and said lower surfaces, one of said first pair of said end faces being joined to one of said second pair of said end faces, and each of said first pair of said end faces and each of said second pair of said end faces being joined to one of said pair of said side faces;

providing a second translucent block including a pair of parallel top and bottom surfaces of identical shape and a generally rectangular abutting surface having said first preselected height and being perpendicular and joined to said top and said bottom surfaces; and joining one of said side faces and said end faces of said first block in abutting relationship with said abutting rectangular surface of said second block with said abutting rectangular surface having a generally corresponding width which corresponds to an appropriate one of said first preselected width and said second preselected width of said one of said sides and said ends of said first block to form a horizontal layer of said translucent block wall structure.

20. The method of forming a translucent block wall structure as set forth in claim 19, further including forming a plurality of said horizontal layers as said upper surface of each of said first blocks is joined to said lower surface of each adjacent said first block thereabove and said top surface of each of said second blocks is joined to said bottom surface of each adjacent said second block thereabove.

21. A method of forming a translucent block column structure comprising the steps of:

providing a translucent corner block including a pair of parallel upper and lower surfaces each having a generally irregular hexagonal shape, a pair of generally rectangular, opposing sides which are parallel with each other, have a first preselected height and a first preselected width, and are perpendicular and joined to said upper and said lower surfaces, a first pair of generally rectangular, opposing end faces which are parallel with each other, have said first preselected height and a second preselected width, and are perpendicular and joined to said upper and said lower surfaces, a second pair of generally rectangular, opposing end faces which are parallel with each other, have said first preselected height and said second preselected width, and are perpendicular and joined to said upper and said lower surfaces, one of said first pair of said end faces being joined to one of said second pair of said end faces, and each of said first pair of said end faces and each of said second pair of said end faces being joined to one of said pair of said side faces;

providing a plurality of at least three additional translucent blocks each of which respectively includes a pair of parallel upper and lower surfaces having identical shapes, a first of said additional translucent blocks having a first generally rectangular abutting surface having said first preselected height and being perpendicular and joined to said upper and said lower surfaces thereof, a second of said additional translucent blocks having a second generally rectangular abutting surface having said first preselected height and being perpendicular and joined to said upper and said lower surfaces thereof;

joining one of said side faces and said end faces of said translucent corner block in abutting relationship with said first abutting rectangular surface of said first of said additional translucent blocks with said first abutting rectangular surface having a first corresponding width which corresponds to an appropriate one of said first preselected width and second preselected width of said one of said side faces and said end faces of said translucent corner block;

joining another of said side faces and said end faces of said translucent corner block in abutting relationship with said second abutting rectangular surface of said second of said additional translucent blocks with said second abutting rectangular surface having a second corresponding width which corresponds to an appropriate one of said first preselected width and said second preselected width of said other of said side faces and said end faces of said translucent block; and joining said translucent corner block and said additional translucent blocks in an encircling array to form a horizontal layer of said translucent block column structure.

22. The method of forming a translucent block column structure as set forth in claim 21, further including the step of forming a plurality of said horizontal layers as said upper surface of each of said translucent blocks is joined to said lower surface of each adjacent said translucent block thereabove and said upper surface of each of said additional translucent blocks is respectively joined to said bottom surface of each corresponding adjacent said additional translucent block thereabove.

* * * * *